US012612727B2

(12) United States Patent
Djerekarov et al.

(10) Patent No.: US 12,612,727 B2
(45) Date of Patent: Apr. 28, 2026

(54) CORROSION RESISTANCE IN HEAT PUMP AND LAUNDRY APPLIANCES

(71) Applicant: Haier US Appliance Solutions, Inc., Wilmington, DE (US)

(72) Inventors: Jivko Ognianov Djerekarov, Louisville, KY (US); Sydney Baker, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 876 days.

(21) Appl. No.: 17/956,359

(22) Filed: Sep. 29, 2022

(65) Prior Publication Data

US 2024/0110328 A1 Apr. 4, 2024

(51) Int. Cl.

| | |
|---|---|
| ***D06F 58/38*** | (2020.01) |
| ***D06F 25/00*** | (2006.01) |
| ***D06F 33/52*** | (2020.01) |
| ***D06F 34/26*** | (2020.01) |
| ***D06F 58/02*** | (2006.01) |

(Continued)

(52) U.S. Cl.

CPC ..... *D06F 58/38* (2020.02); *D06F 25/00* (2013.01); *D06F 33/52* (2020.02); *D06F 34/26* (2020.02); *D06F 58/02* (2013.01); *D06F 58/206* (2013.01); *D06F 2103/34* (2020.02); *D06F 2103/50* (2020.02); *D06F 2105/30* (2020.02); *D06F 2105/32* (2020.02)

(58) Field of Classification Search

CPC ..... D06F 58/38; D06F 33/52; D06F 34/26; D06F 25/00; D06F 58/02; D06F 58/206; D06F 2105/32; D06F 2103/34; D06F 2103/20; D06F 2105/30

USPC ..... 34/477, 595–610

See application file for complete search history.

(56) References Cited

U.S. PATENT DOCUMENTS 7,020,985 B2 * 4/2006 Casey ..... D06F 58/206 34/595
7,908,766 B2 * 3/2011 Ahn ..... D06F 58/206 219/684

(Continued)

FOREIGN PATENT DOCUMENTS

AU 2013207188 B2 * 3/2017 ..... D06F 58/206
CN 105671903 A 6/2016

(Continued)

*Primary Examiner* — Stephen M Gravini
(74) *Attorney, Agent, or Firm* — Dority & Manning, P.A.

(57) ABSTRACT

A heat pump appliance may include a cabinet, a sealed thermodynamic assembly, a blower fan, a temperature sensor, and a controller. The sealed thermodynamic assembly may include a fluid compressor, an evaporator, and a condenser disposed along the air path. The temperature sensor may be mounted to the evaporator to detect temperature at the evaporator. The controller may be configured to direct a drying operation. The drying operation may include activating the fluid compressor to motivate a refrigerant through the sealed thermodynamic assembly, activating the blower fan to motivate the airflow across the condenser, directing the fluid compressor to an inactive state following activating the blower fan, detecting an evaporator temperature at the temperature sensor while the fluid compressor is in the inactive state following activating the blower fan, and adjusting activation of the blower fan based on the detected evaporator temperature.

20 Claims, 6 Drawing Sheets

(51) Int. Cl.

| | |
|---|---|
| ***D06F 58/20*** | (2006.01) |
| ***D06F 103/34*** | (2020.01) |
| ***D06F 103/50*** | (2020.01) |
| ***D06F 105/30*** | (2020.01) |
| ***D06F 105/32*** | (2020.01) |

(56) References Cited

U.S. PATENT DOCUMENTS

| | | | | |
|---|---|---|---|---|
| 8,640,360 | B2 * | 2/2014 | Stamm | F04D 25/08 702/182 |
| 8,695,230 | B2 * | 4/2014 | Noh | D06F 58/34 62/298 |
| 8,973,286 | B1 * | 3/2015 | Hyde | D06F 58/30 68/5 R |
| 9,097,462 | B2 * | 8/2015 | Lorenc | D06F 58/20 |
| 9,487,910 | B2 * | 11/2016 | Huang | D06F 58/206 |
| 9,834,882 | B2 * | 12/2017 | Patil | D06F 58/206 |
| 12,043,950 | B2 * | 7/2024 | Yoon | D06F 58/24 |
| 12,188,172 | B2 * | 1/2025 | Ryoo | D06F 58/48 |
| 12,338,570 | B2 * | 6/2025 | Yeom | D06F 58/26 |
| 12,414,673 | B2 * | 9/2025 | Kim | A47L 23/18 |
| 2024/0110328 | A1 * | 4/2024 | Djerekarov | D06F 58/02 |

FOREIGN PATENT DOCUMENTS

| | | | | |
|---|---|---|---|---|
| CN | 115968418 | A * | 4/2023 | D06F 58/48 |
| EP | 2612966 | A1 * | 7/2013 | D06F 58/206 |
| JP | 4531414 | B2 | 8/2010 | |
| KR | 100577245 | B1 | 5/2006 | |
| KR | 20210009889 | A | 1/2021 | |
| WO | WO-2021261910 | A1 * | 12/2021 | D06F 58/48 |

* cited by examiner

CORROSION RESISTANCE IN HEAT PUMP AND LAUNDRY APPLIANCES

FIELD OF THE INVENTION

The present subject matter relates generally to appliances using a heat pump, such as combination washer-dryer appliances.

BACKGROUND OF THE INVENTION

Heat pump appliances, such as washer-dryer appliances, closed loop dryer appliances, etc., have become increasingly popular in recent years. In particular, heat pump appliances are often attractive for their energy efficiencies (e.g., in comparison to burner systems that rely on combustible fuels to generate heat). Such heat pump appliances generally include a fluid compressor that motivates a liquid refrigerant through one or more heat exchangers in order to heat air passing over the heat exchanger(s). For instance, a laundry appliance may define a closed airflow circuit that circulates air across a sealed heat pump system. In particular, air may be motivated through a drum and across a heat pump using a blower. Hot air from a condenser may enter the drum and become saturated with moisture from wet clothes. The saturated air may then pass over a filter, resulting in the condensation of water. Air may then be reheated as it moves back across the condenser.

One of the issues that can arise with such systems is that moisture can accumulate at various portions of the system. As an example, moisture may accumulate on the metal tubing or heat-exchange structure of the evaporator. These may lead to corrosion of the evaporator or the accumulation of mold, mildew, etc. In turn, damage to the appliance or clothes within the appliance may occur.

As a result, it would be useful to provide a system or method to resist damage linked to moisture accumulation. In particular, it may be advantageous to provide a system or method capable of preventing moisture accumulation and, in turn, damage that may be caused by the same in heat pump appliances, such as laundry appliances for heating or drying clothes.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a heat pump appliance is provided. The heat pump appliance may include a cabinet, a sealed thermodynamic assembly, a blower fan, a temperature sensor, and a controller. The cabinet may define an air path therethrough. The sealed thermodynamic assembly may be mounted within the cabinet. The sealed thermodynamic assembly may include a fluid compressor, an evaporator, and a condenser disposed along the air path. The blower fan may be mounted within the cabinet to motivate an airflow across the condenser. The temperature sensor may be mounted to the evaporator to detect temperature at the evaporator. The controller may be in operative communication with the fluid compressor, the blower fan, and the temperature sensor. The controller may be configured to direct a drying operation. The drying operation may include activating the fluid compressor to motivate a refrigerant through the sealed thermodynamic assembly, activating the blower fan to motivate the airflow across the condenser, directing the fluid compressor to an inactive state following activating the blower fan, detecting an evaporator temperature at the temperature sensor while the fluid compressor is in the inactive state following activating the blower fan, and adjusting activation of the blower fan based on the detected evaporator temperature.

In another exemplary aspect of the present disclosure, a method of operating a heat pump appliance is provided. The method may include activating a fluid compressor to motivate a refrigerant through a sealed thermodynamic assembly. The method may further include activating a blower fan to motivate an airflow across a condenser and directing the fluid compressor to an inactive state following activating the blower fan. The method may still further include detecting an evaporator temperature at a temperature sensor while the fluid compressor is in the inactive state following activating the blower fan. The method may yet further include adjusting activation of the blower fan based on the detected evaporator temperature.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
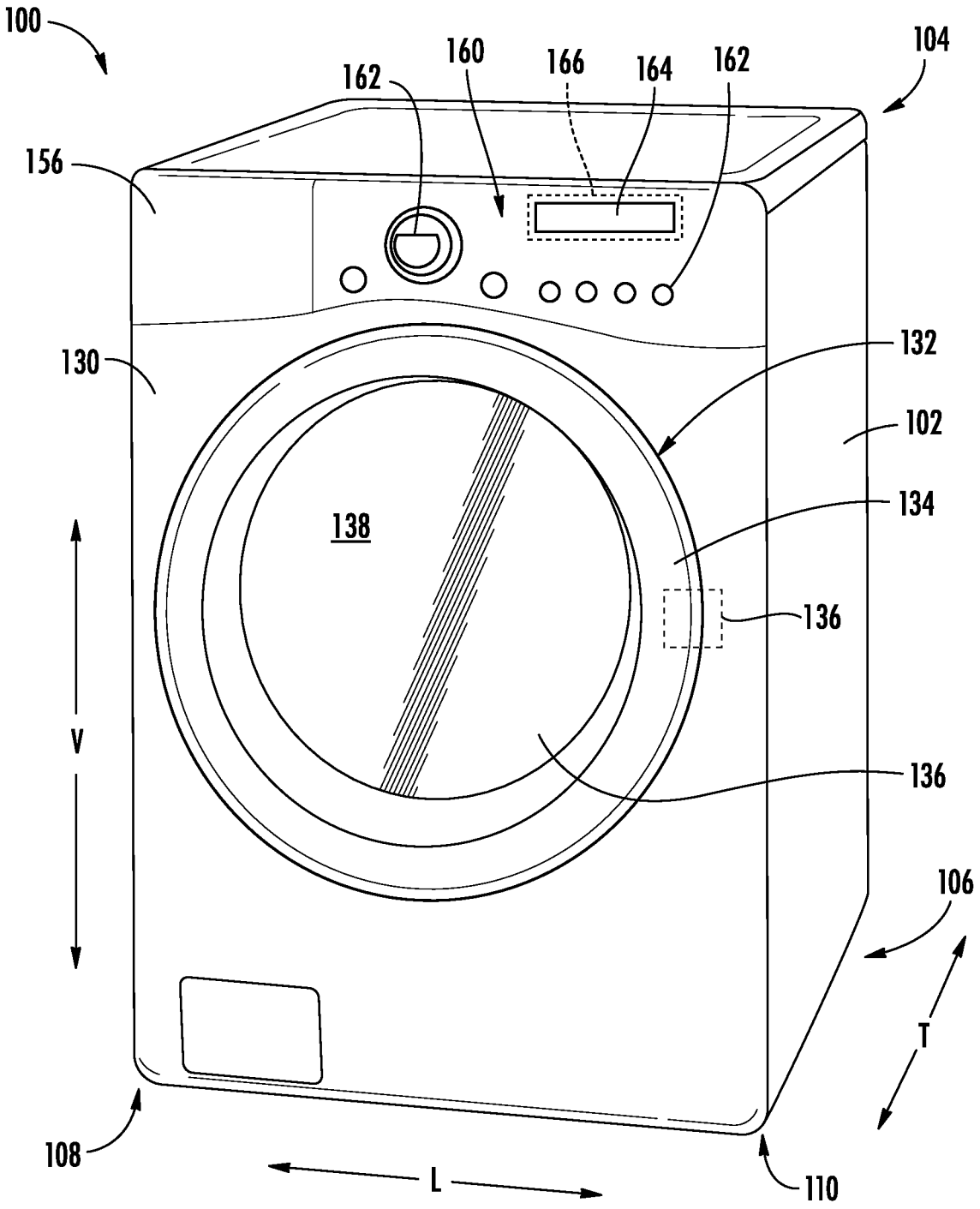
FIG. 1 provides a perspective view of a laundry appliance in accordance with exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
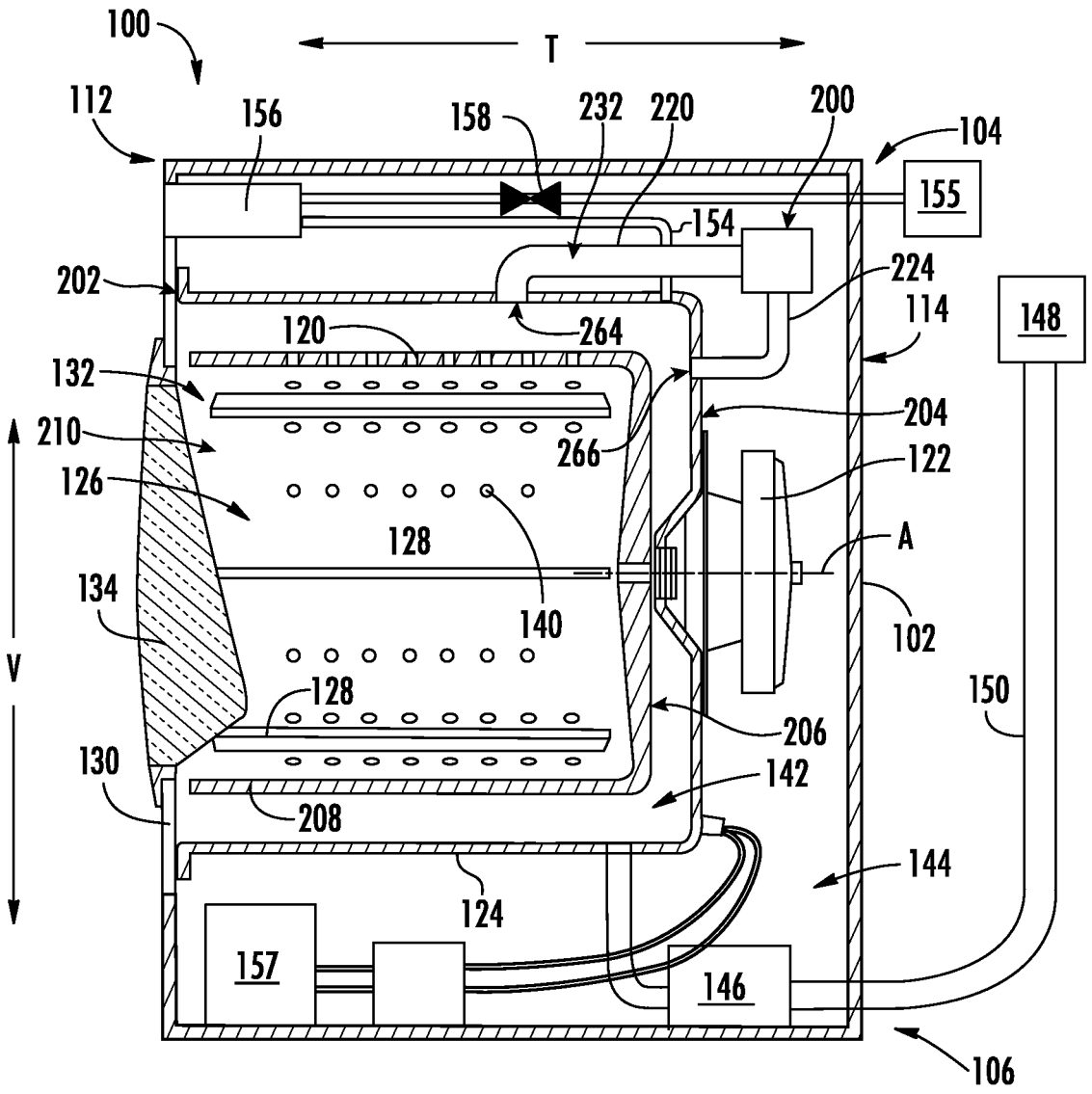
FIG. 2 provides a side cross-sectional view of the exemplary laundry appliance of FIG. 1.

Referring now to the figures, an exemplary heat pump appliance that may be used to implement aspects of the present subject matter will be described. The illustrated heat pump appliance is shown as a laundry appliance. Specifically, FIG. 1 is a perspective view of an exemplary horizontal axis washer and condenser dryer combination appliance 100, referred to herein for simplicity as laundry appliance 100. FIG. 2 is a side cross-sectional view of laundry appliance 100. As illustrated, laundry appliance 100 generally defines a vertical direction V, a lateral direction L, and a transverse direction T, each of which is mutually perpendicular, such that an orthogonal coordinate system is generally defined. Laundry appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIG. 2, a laundry basket 120 is rotatably mounted within cabinet 102 such that it is rotatable about an axis of rotation A. According to the illustrated embodiment, axis of rotation A is substantially parallel to the horizontal direction (e.g., the transverse direction T), as this exemplary appliance is a front load appliance. A motor 122, e.g., such as a pancake motor, is in mechanical communication with laundry basket 120 to selectively rotate laundry basket 120 (e.g., during an agitation or a rinse cycle of laundry appliance 100). Motor 122 may be mechanically coupled to laundry basket 120 directly or indirectly, e.g., via a pulley and a belt (not pictured). Laundry basket 120 is received within a tub 124 that defines a chamber 126 that is configured for receipt of articles for washing or drying.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be washed together or dried together in laundry appliance 100 (e.g., the combination washer and condenser dryer) and may include a mixture of different or similar articles of clothing of different or similar types and kinds of fabrics, textiles, garments and linens within a particular laundering process.

The tub 124 holds wash and rinse fluids for agitation in laundry basket 120 within tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Laundry basket 120 may define one or more agitator features that extend into chamber 126 to assist in agitation, cleaning, and drying of articles disposed within chamber 126 during operation of laundry appliance 100. For example, as illustrated in FIG. 2, a plurality of baffles or ribs 128 extend from basket 120 into chamber 126. In this manner, for example, ribs 128 may lift articles disposed in laundry basket 120 and then allow such articles to tumble back to a bottom of drum laundry basket 120 as it rotates. Ribs 128 may be mounted to laundry basket 120 such that ribs 128 rotate with laundry basket 120 during operation of laundry appliance 100.

Referring generally to FIGS. 1 and 2, cabinet 102 also includes a front panel 130 which defines an opening 132 that permits user access to laundry basket 120 and tub 124. More specifically, laundry appliance 100 includes a door 134 that is positioned over opening 132 and is rotatably mounted to front panel 130. In this manner, door 134 permits selective access to opening 132 by being movable between an open position (not shown) facilitating access to a tub 124 and a closed position (FIG. 1) prohibiting access to tub 124. Laundry appliance 100 may further a latch assembly 136 (see FIG. 1) that is mounted to cabinet 102 or door 134 for selectively locking door 134 in the closed position. Latch assembly 136 may be desirable, for example, to ensure only secured access to chamber 126 or to otherwise ensure and verify that door 134 is closed during certain operating cycles or events.

A window 138 in door 134 permits viewing of laundry basket 120 when door 134 is in the closed position, e.g., during operation of laundry appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments.

Referring again to FIG. 2, laundry basket 120 also defines a plurality of perforations 140 in order to facilitate fluid communication between an interior of basket 120 and tub 124. A sump 142 is defined by tub 124 at a bottom of tub 124 along the vertical direction V. Thus, sump 142 is configured for receipt of and generally collects wash fluid during operation of laundry appliance 100. For example, during operation of laundry appliance 100, wash fluid may be urged by gravity from basket 120 to sump 142 through plurality of perforations 140.

A drain pump assembly 144 is located beneath tub 124 and is in fluid communication with sump 142 for periodically discharging soiled wash fluid from laundry appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

A spout 154 is configured for directing a flow of fluid into tub 124. For example, spout 154 may be in fluid communication with a water supply 155 (FIG. 2) in order to direct fluid (e.g., clean water or wash fluid) into tub 124. Spout 154 may also be in fluid communication with the sump 142. For example, pump assembly 144 may direct wash fluid disposed in sump 142 to spout 154 in order to circulate wash fluid in tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash chamber 126 during operation of laundry appliance 100. According to the illustrated embodiment, detergent drawer 156 may also be fluidly coupled to spout 154 to facilitate the complete and accurate dispensing of wash additive.

In optional embodiments, a bulk reservoir 157 is disposed within cabinet 102 and is configured for receipt of fluid additive or detergent for use during operation of laundry appliance 100. Moreover, bulk reservoir 157 may be sized such that a volume of fluid additive sufficient for a plurality or multitude of wash cycles of laundry appliance 100 (e.g., five, ten, twenty, fifty, or any other suitable number of wash cycles) may fill bulk reservoir 157. Thus, for example, a user can fill bulk reservoir 157 with fluid additive and operate laundry appliance 100 for a plurality of wash cycles without refilling bulk reservoir 157 with fluid additive. A reservoir pump (not shown) may be configured for selective delivery of the fluid additive from bulk reservoir 157 to tub 124.

In addition, a water supply valve or control valve 158 may provide a flow of water from a water supply source (such as a municipal water supply 155) into detergent dispenser 156 or into tub 124. In this manner, control valve 158 may generally be operable to supply water into detergent dispenser 156 to generate a wash fluid, e.g., for use in a wash cycle, or a flow of fresh water, e.g., for a rinse cycle. It should be appreciated that control valve 158 may be positioned at any other suitable location within cabinet 102. In addition, although control valve 158 is described herein as regulating the flow of "wash fluid," it should be appreciated that this term includes, water, detergent, other additives, or some mixture thereof.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, or other items of interest to machine users.

Operation of laundry appliance 100 is controlled by a controller or processing device 166 (FIG. 1) that is operatively coupled to control panel 160 for user manipulation to select laundry cycles and features. In response to user manipulation of control panel 160, controller 166 operates the various components of laundry appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog or digital logic circuitry (such as switches, amplifiers, integrators, comparators, flip-flops, AND gates, and the like) to perform control functionality instead of relying upon software. Control panel 160 and other components of laundry appliance 100 may be in communication with controller 166 via one or more signal lines or shared communication busses.

During operation of laundry appliance 100, laundry items are loaded into laundry basket 120 through opening 132, and washing operation is initiated through operator manipulation of input selectors 162. Tub 124 is filled with water, detergent, or other fluid additives, e.g., via spout 154 and or detergent drawer 156. One or more valves (e.g., control valve 158) can be controlled by laundry appliance 100 to provide for filling laundry basket 120 to the appropriate level for the amount of articles being washed or rinsed. By way of example for a wash mode, once laundry basket 120 is properly filled with fluid, the contents of laundry basket 120 can be agitated (e.g., with ribs 128) for washing of laundry items in laundry basket 120.

After the agitation phase of the wash cycle is completed, tub 124 can be drained. Laundry articles can then be rinsed by again adding fluid to tub 124, depending on the particulars of the cleaning cycle selected by a user. Ribs 128 may again provide agitation within laundry basket 120. One or more spin cycles may also be used. In particular, a spin cycle may be applied after the wash cycle or after the rinse cycle in order to wring wash fluid from the articles being washed. During a final spin cycle, basket 120 is rotated at relatively high speeds and drain pump assembly 144 may discharge wash fluid from sump 142. After articles disposed in laundry basket 120 are cleaned, washed, or rinsed, the user can remove the articles from laundry basket 120, e.g., by opening door 134 and reaching into laundry basket 120 through opening 132.

While described in the context of a specific embodiment of horizontal axis laundry appliance 100, using the teachings disclosed herein it will be understood that horizontal axis laundry appliance 100 is provided by way of example only. Other heat pump appliances having different configurations, different appearances, or different features may also be utilized with the present subject matter as well, e.g., vertical axis laundry appliances, closed loop dryer appliances, air conditioning appliances, etc. Indeed, it should be appreciated that aspects of the present subject matter may further apply to other appliances. In this regard, the same methods as systems and methods as described herein may be used to implement drying or dry air cycles for other appliances, as described in more detail below.

Figure 3:
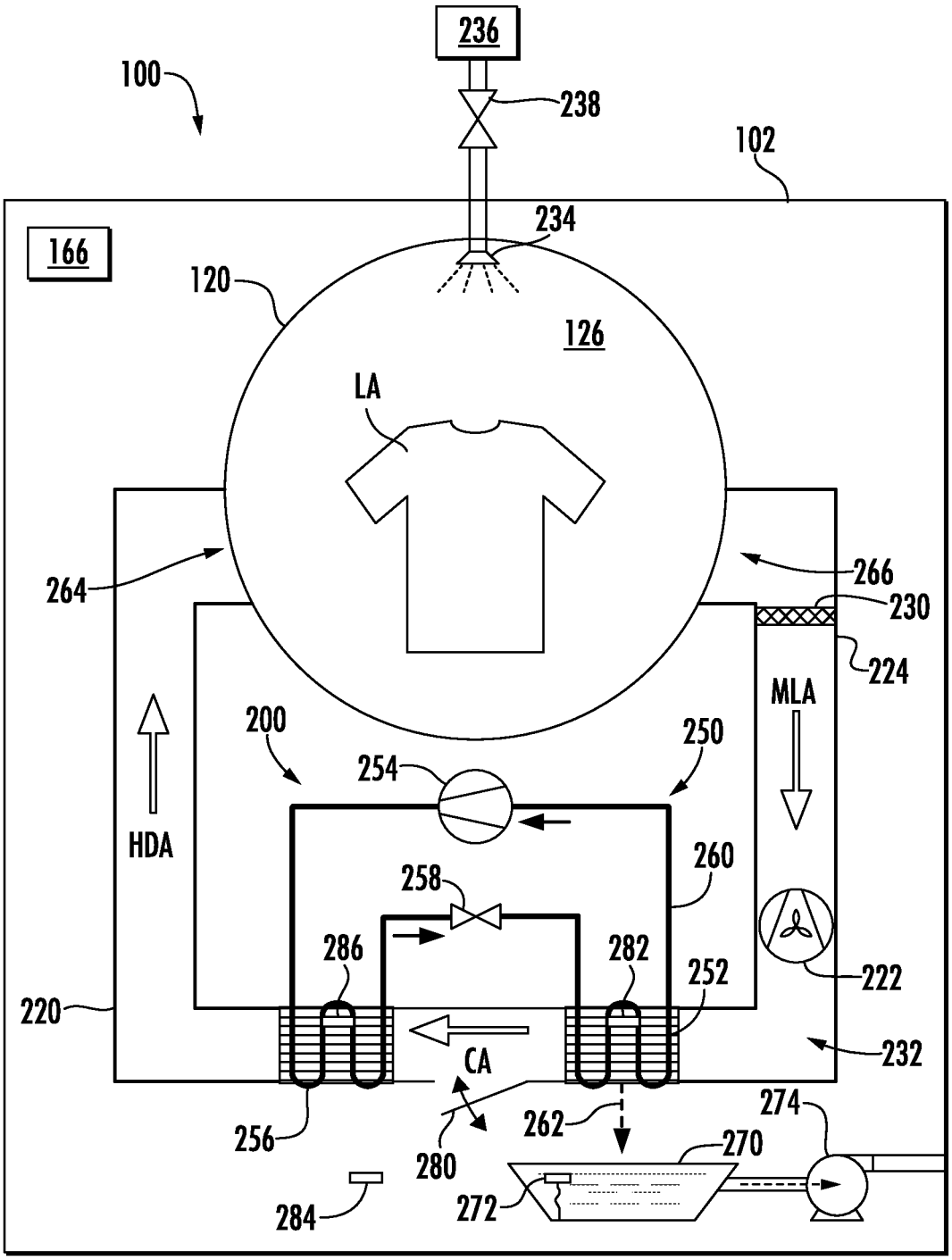
FIG. 3 provides a schematic diagram of an exemplary heat pump dryer appliance and a conditioning system thereof in accordance with exemplary embodiments of the present disclosure.

Referring now specifically to FIGS. 2 and 3, a heat pump system, a condenser system, a refrigerant-based air conditioning system, or another suitable conditioning system 200 for facilitating a drying process within laundry appliance 100 will be described in more detail. As illustrated, conditioning system 200 may be mounted to tub 124 such that it is fluidly coupled to chamber 126. More specifically, as illustrated, tub 124 extends between a front portion 202 and a back portion 204, e.g., along the transverse direction T. Laundry basket 120 also includes a back or rear wall 206, e.g., at back portion of laundry basket 120 or proximate back portion 204 of tub 124. Rear wall 206 of laundry basket 120 may be rotatably supported within cabinet 102 by a suitable bearing or may be fixed or rotatable.

In some embodiments, laundry basket 120 is generally cylindrical in shape. Laundry basket 120 has an outer cylindrical wall 208 and a front flange or wall that defines an opening 210 of laundry basket 120, e.g., at front portion 202 of laundry basket 120. As shown, opening 210 generally coincides with opening 132 of front panel 112 of cabinet 102, e.g., to provide user access to chamber 126 for loading and unloading of articles into and out of chamber 126 of laundry basket 120.

Conditioning system 200 may generally include a return duct 220 that is mounted to tub 124 for circulating air within chamber 126 to facilitate a drying process. For example, according to the illustrated exemplary embodiment, return duct 220 is fluid coupled to tub 124 proximate a top of tub 124. Return duct 220 receives heated air that has been heated or dehumidified by a conditioning system 200 and provides the heated air to laundry basket 120 via one or more holes defined by rear wall 206 or cylindrical wall 208 of laundry basket 120 (e.g., such as perforations 140).

Specifically, moisture laden, heated air is drawn from laundry basket 120 by an air handler, such as a blower fan 222, which generates a negative air pressure within laundry basket 120. As the air passes from blower fan 222, it enters an intake duct 224 and then is passed into conditioning system 200. According to the illustrated exemplary embodiment, laundry appliance 100 is a heat pump dryer appliance and thus conditioning system 200 may be or include a heat pump including a sealed refrigerant circuit, as described in more detail below with reference to FIG. 3. Heated air (with a lower moisture content than was received from laundry basket 120), exits conditioning system 200 and returns to laundry basket 120 by a return duct 220. After the clothing articles have been dried, they are removed from the laundry basket 120 via opening 132.

As shown, laundry appliance 100 may further include one or more lint filters 230 (FIG. 3) to collect lint during drying operations. The moisture laden heated air passes through intake duct 224 enclosing screen filter 230, which traps lint particles. More specifically, filter 230 may be placed into an air flow path 232 defined by laundry basket 120, conditioning system 200, intake duct 224, and return duct 220. Filter 230 may be positioned in the process air flow path 232 and may include a screen, mesh, other material to capture lint in the air flow 232. The location of lint filters in laundry appliance 100 as shown in FIG. 3 is provided by way of example only, and other locations may be used as well. According to exemplary embodiments, lint filter 230 is readily accessible by a user of the appliance. As such, lint filter 230 should be manually cleaned by removal of the filter, pulling or wiping away accumulated lint, and then replacing the filter 230 for subsequent drying cycles.

According to optional embodiments, laundry appliance 100 can selectively facilitate a steam dry process. In this regard, laundry appliance 100 may offer a steam drying cycle, during which steam is injected into chamber 126, e.g., to function similar to a traditional garment steamer to help remove wrinkles, static, etc. Accordingly, as shown for example in FIG. 3, laundry appliance 100 may include a misting nozzle 234 that is in fluid communication with a water supply 236 (e.g., such as water supply 155) in order to direct mist into chamber 126. Laundry appliance 100 may further include a water supply valve or control valve 238 for selecting discharging the flow of mist into chamber 126. It should be appreciated that control valve 238 may be positioned at any other suitable location within cabinet 102.

FIG. 3 provides a schematic view of laundry appliance 100 and depicts conditioning system 200 in more detail. For this embodiment, laundry appliance 100 is a heat pump dryer appliance and thus conditioning system 200 includes a sealed thermodynamic assembly or system 250.

Sealed system 250 includes various operational components, which can be encased or located within a machinery compartment of laundry appliance 100. Generally, the operational components are operable to execute a vapor compression cycle for heating process air passing through conditioning system 200. The operational components of sealed system 250 include an evaporator 252, a fluid compressor 254, a condenser 256, or one or more expansion devices 258 connected in series along a refrigerant circuit or line 260. Refrigerant line 260 is charged with a working fluid, which in this example is a refrigerant.

Sealed system 250 depicted in FIG. 3 is provided by way of example only. Thus, it is within the scope of the present subject matter for other configurations of the sealed system to be used as well. As will be understood by those skilled in the art, sealed system 250 may include additional components, e.g., at least one additional evaporator, compressor, expansion device, or condenser. As an example, sealed system 250 may include two (2) evaporators.

Similarly, the above-described vapor-compression system may be substituted for other suitable heat-exchange systems, such as a system relying on shape-memory alloys (SMA). For instance, a pair of discrete fluid circuits (e.g., a hot circuit and a cold circuit) each having a discrete volume of heat-carrying fluid (e.g., water, brine, glycol, air, etc.) may be separately connected to a compression unit—the compression unit housing a plurality of plate stacks each having one or more plates formed from one or more SMA material (e.g., copper-nickel-aluminum or nickel-titanium). Separate heat exchangers may generally be provided on the circuits in place of the evaporator and the condenser of a sealed system. In particular, a first heat exchanger may be provided on the cold circuit (e.g., in place of the evaporator) to absorb heat from the adjacent air and impart such absorbed heat to the heat-carrying fluid within the cold circuit. Thus, the first heat exchanger may also be referred to as an "evaporator" herein. Similarly, a second heat exchanger may be provided on the hot circuit (e.g., in place of the condenser) to release heat to the adjacent air from the heat-carrying fluid within the hot circuit. Thus, the second heat exchanger may also be referred to as a "condenser" herein.

The compression unit may facilitate or direct heat between the circuits. As an example, the compression unit may have four discrete plate stacks, each being separately compressed or released by a corresponding mechanical press or vice (e.g., hydraulic ram or electric actuator). During use, the plate stacks may be compressed and released (e.g., alternated between a compressed state or stroke and a released state or stroke) separately such that at any given moment one plate stack is compressed, one plate stack is released, one plate stack is mid-compression, and one plate stack is mid-release. Heat-carrying fluid in the cold circuit may flow through the first heat exchanger, before being directed (e.g., by a series of valves or pumps, which may be simultaneously referenced as a "fluid compressor") into the plate stack that is currently compressed. The compressed plate stack may then be moved to the released state, in turn absorbing heat from the heat-carrying fluid before the heat-carrying fluid within the now-released plate stack is returned to the cold circuit (e.g., to repeat the cycle). In contrast to the cold circuit, heat-carrying fluid in the hot circuit may flow through the second heat exchanger and be directed (e.g., by a separate series of valves or pump, which may be simultaneously referenced as a "fluid compressor") into the plate stack that is currently released. The released plate stack may then be compressed (i.e., moved to the compressed stated), in turn releasing heat from the plate stack to the heat-carrying fluid before the heat-carrying fluid within the now-compressed plate stack is returned to the hot circuit (e.g., to repeat the cycle). The use of four plate stacks may allow both circuits to run continuously.

In performing a drying or tumbling cycle, one or more laundry articles LA may be placed within the chamber 126 of laundry basket 120. Hot dry air HDA is supplied to chamber 126 via return duct 220. The hot dry air HDA enters chamber 126 of laundry basket 120 via a tub inlet 264 defined by laundry basket 120, e.g., the plurality of holes defined in rear wall 206 or cylindrical wall 208 of laundry basket 120 as shown in FIG. 2. The hot dry air HDA provided to chamber 126 causes moisture within laundry articles LA to evaporate. Accordingly, the air within chamber 126 increases in water content and exits chamber 126 as warm moisture laden air MLA. The warm moisture laden air MLA exits chamber 126 through a tub outlet 266 defined by laundry basket 120 and flows into intake duct 224.

After exiting chamber 126 of laundry basket 120, the warm moisture laden air MLA flows downstream to conditioning system 200. Blower fan 222 moves the warm moisture laden air MLA, as well as the air more generally, through a process air flow path 232 defined by laundry basket 120, conditioning system 200, intake duct 224, and return duct 220. Thus, generally, blower fan 222 is operable to move air through or along the process air flow path 232. The duct system includes all ducts that provide fluid communication (e.g., airflow communication) between tub outlet 266 and conditioning system 200 and between conditioning system 200 and tub inlet 264. Although blower fan 222 is shown positioned between laundry basket 120 and conditioning system 200 along intake duct 224, it will be appreciated that blower fan 222 can be positioned in other suitable positions or locations along the duct system.

As further depicted in FIG. 3, the warm moisture laden air MLA flows into or across evaporator 252 of the conditioning system 200. As the moisture-laden air MLA passes across evaporator 252, the temperature of the air is reduced through heat exchange with refrigerant that is vaporized within, for example, coils or tubing of evaporator 252. This vaporization process absorbs both the sensible and the latent heat from the moisture-laden air MLA—thereby reducing its temperature. As a result, moisture in the air is condensed and such condensate water may be drained from conditioning system 200, e.g., using a drain line 262, which is also depicted in FIG. 3.

In some embodiments, a temperature sensor 282 is provided on or adjacent to evaporator 252 (e.g., to detect a temperature of evaporator 252). Specifically, the evaporator temperature sensor 282 may be mounted on evaporator 252 and configured to detect a temperature of the same. Generally, temperature sensor 282 includes or is provided as any suitable sensor for detecting or measuring temperature and communicating such temperatures to, for instance, controller 166. To that end, temperature sensor 282 may be communicatively coupled with controller 166 (e.g., via a suitable wired or wireless communication link) and may include, for instance, a thermistor or thermocouple (e.g., disposed on evaporator 252).

In the illustrated embodiment, a condenser tank or a condensate collection tank 270 is in fluid communication with conditioning system 200, e.g., via drain line 262. Collection tank 270 is operable to receive condensate water from the process air flowing through conditioning system 200, and more particularly, condensate water from evaporator 252. A level sensor 272 operable to detect when water within collection tank 270 has reached a predetermined level. Level sensor 272 can be any suitable type of sensor configured to detect a predetermined volume, height, or amount of liquid, such as a float switch as shown in FIG. 3. Level sensor 272 can be communicatively coupled with controller 166, e.g., via a suitable wired or wireless communication link. A drain pump 274 is in fluid communication with collection tank 270. Drain pump 274 is operable to remove a volume of water from collection tank 270 and, for example, discharge the collected condensate to an external drain. In some embodiments, drain pump 274 can remove a known or predetermined volume of water from collection tank 270. Drain pump 274 can remove the condensate water from collection tank 270 and can move or drain the condensate water downstream, e.g., to a gray water collection system. Particularly, in some embodiments, controller 166 is configured to receive, from level sensor 272, an input indicating that water within the collection tank has reached the predetermined level. In response to the input indicating that water within collection tank 270 has reached the predetermined level, controller 166 can cause drain pump 274 to remove the predetermined volume of water from collection tank 270.

Air passing over evaporator 252 becomes cooler than when it exited laundry basket 120 at tub outlet 266. As shown in FIG. 3, cool air CA (cool relative to hot dry air HDA and moisture laden air MLA) flowing downstream of evaporator 252 is subsequently caused to flow across condenser 256, e.g., across coils or tubing thereof, which condenses refrigerant therein. The refrigerant enters condenser 256 in a gaseous state at a relatively high temperature compared to the cool air CA from evaporator 252. As a result, heat energy is transferred to the cool air CA at the condenser 256, thereby elevating its temperature and providing warm dry air HDA for resupply to laundry basket 120 of laundry appliance 100.

In some embodiments, a temperature sensor 286 is provided on or adjacent to condenser 256 (e.g., to detect a temperature of condenser 256). Specifically, the condenser temperature sensor 286 may be mounted on condenser 256 and configured to detect a temperature of the same. Generally, temperature sensor 286 includes or is provided as any suitable sensor for detecting or measuring temperature and communicating such temperatures to, for instance, controller 166. To that end, temperature sensor 286 may be communicatively coupled with controller 166 (e.g., via a suitable wired or wireless communication link) and may include, for instance, a thermistor or thermocouple (e.g., disposed on condenser 256).

As shown, the warm dry air HDA passes over and around laundry articles LA within the chamber 126 of the laundry basket 120, such that warm moisture laden air MLA is generated, as mentioned above. Because the air is recycled through laundry basket 120 and conditioning system 200, laundry appliance 100 can have a much greater efficiency than traditional clothes dryers can where all of the warm, moisture-laden air MLA is exhausted to the environment.

It is noted that although conditioning system 200 is generally provided as a closed-loop system for recirculating air, one or more movable dampers 280 may be provided to selectively vent air to the ambient environment. For instance, damper 280 may include a corresponding shutter and motor (e.g., communicatively coupled to the controller 166) mounted along process air flow path 232 to selectively open or close process air flow path 232 to a surrounding portion of cabinet 102. Thus, damper may be moved or directed (e.g., by controller 166) to open and permit at least a portion of the treated air or moisture within process air flow path 232 to exhaust to the surrounding portion of cabinet 102. In the illustrated embodiments, damper 280 is mounted along process air flow path 232 between evaporator 252 and condenser 256. In alternative embodiments, damper 280 may be mounted to or formed on another suitable portion of duct 220 or 224.

Outside of air flow path 232, a humidity sensor 284 may be provided and configured to detect a humidity level or dew point of the ambient environment. When assembled, humidity sensor 284 may be mounted apart from temperature sensor 282 or evaporator 252, generally. In some embodiments, humidity sensor 282 is mounted on or within cabinet 102. For instance, humidity sensor 284 may be mounted within cabinet 102, such as within a common chamber or portion of cabinet 102 that houses conditioning system 200 (e.g., including evaporator 252). Humidity sensor 284 may be communicatively coupled with controller 166 (e.g., via a suitable wired or wireless communication link) and may include, for instance, a capacitive hygrometer, resistive hygrometer, thermal hygrometer, or optical hygrometer (e.g., held apart from evaporator 252).

With respect to sealed system 250, compressor 254 pressurizes refrigerant (i.e., increases the pressure of the refrigerant) passing therethrough and generally motivates refrigerant through the sealed refrigerant circuit or refrigerant line 260 of conditioning system 200. Compressor 254 may be communicatively coupled with controller 166 (communication lines not shown in FIG. 3). Refrigerant is supplied from the evaporator 252 to compressor 254 in a low pressure gas phase. The pressurization of the refrigerant within compressor 254 increases the temperature of the refrigerant. The compressed refrigerant is fed from compressor 254 to condenser 256 through refrigerant line 260. As the relatively cool air CA from evaporator 252 flows across condenser 256, the refrigerant is cooled and its temperature is lowered as heat is transferred to the air for supply to chamber 126 of laundry basket 120.

Upon exiting condenser 256, the refrigerant is fed through refrigerant line 260 to expansion device 258. Although only one expansion device 258 is shown, such is by way of example only. It is understood that multiple such devices may be used. In the illustrated example, expansion device 258 is an electronic expansion valve, although a thermal expansion valve or any other suitable expansion device can be used. In additional embodiments, any other suitable expansion device, such as a capillary tube, may be used as well. Expansion device 258 lowers the pressure of the refrigerant and controls the amount of refrigerant that is allowed to enter the evaporator 252. Importantly, the flow of liquid refrigerant into evaporator 252 is limited by expansion device 258 in order to keep the pressure low and allow expansion of the refrigerant back into the gas phase in evaporator 252. The evaporation of the refrigerant in evaporator 252 converts the refrigerant from its liquid-dominated phase to a gas phase while cooling and drying the moisture laden air MLA received from chamber 126 of laundry basket 120. The process is repeated as air is circulated along process air flow path 232 while the refrigerant is cycled through sealed system 250, as described above.

Figure 4:
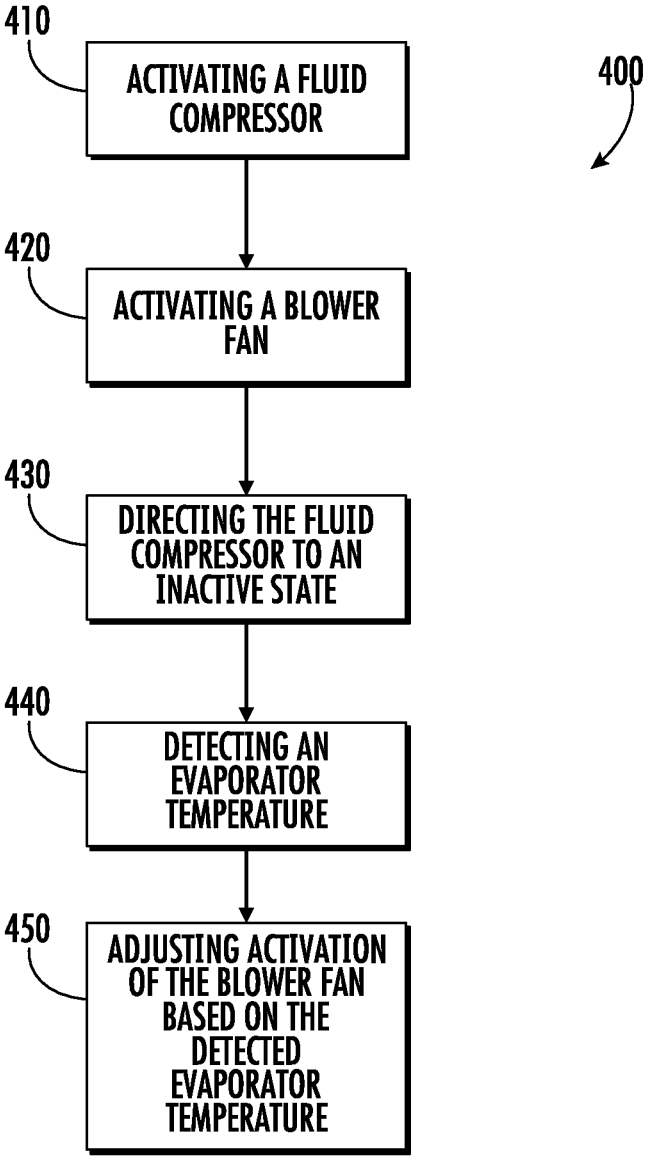
FIG. 4 provides a flow chart illustrating a method of operating a heat pump appliance according to exemplary embodiments of the present disclosure.
Figure 5:
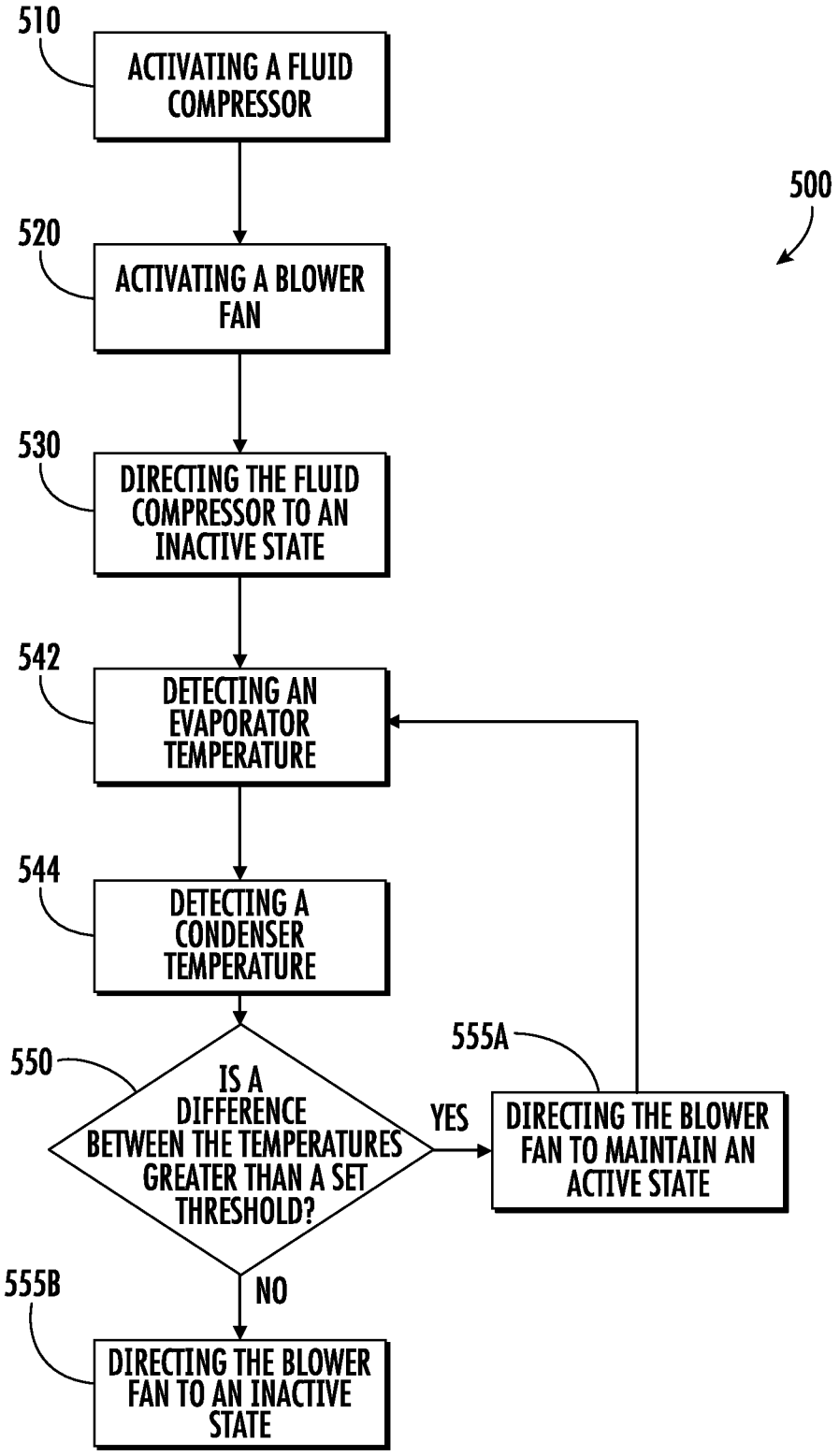
FIG. 5 provides a flow chart illustrating a method of operating a heat pump appliance according to exemplary embodiments of the present disclosure.
Figure 6:
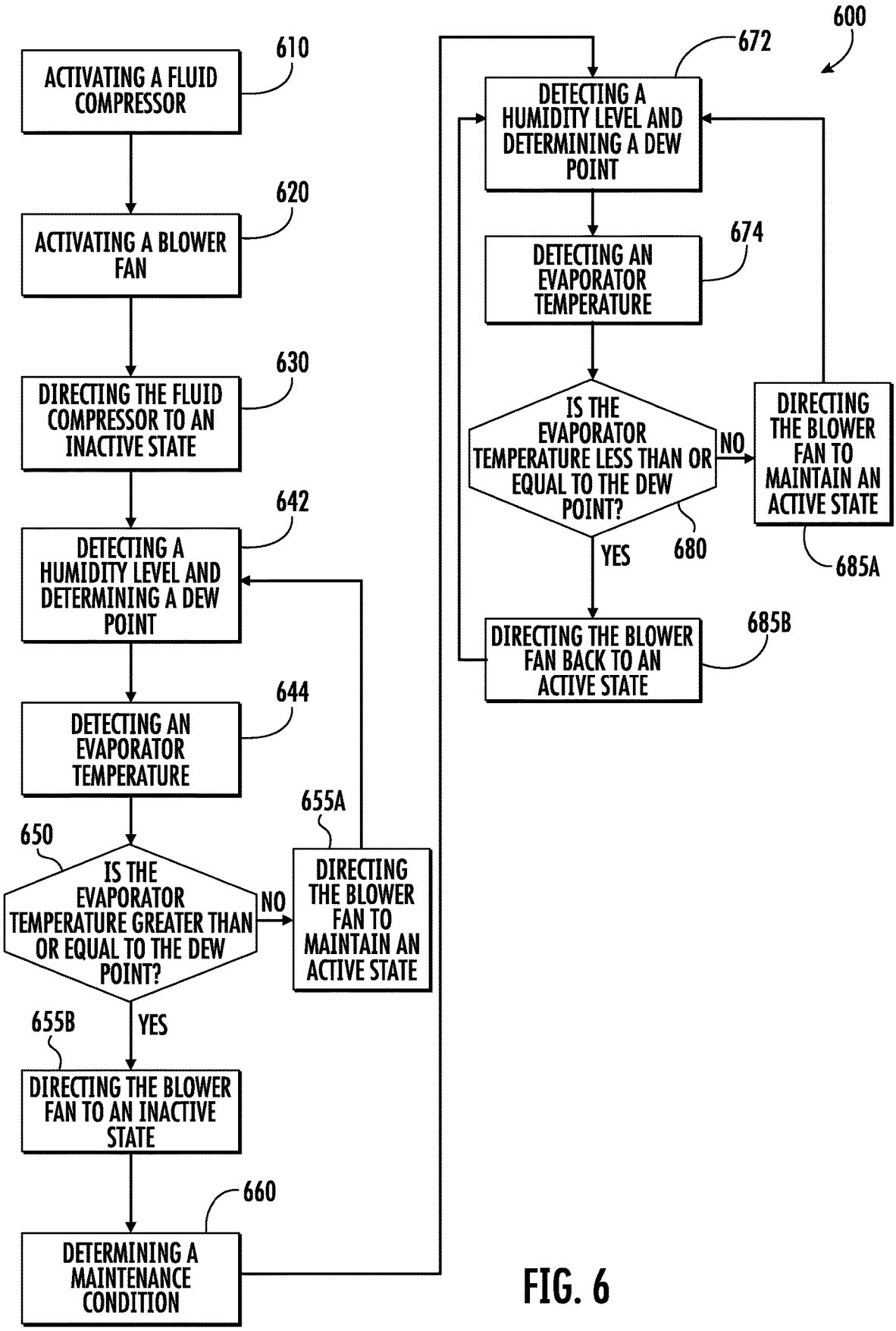
FIG. 6 provides a flow chart illustrating a method of operating a heat pump appliance according to exemplary embodiments of the present disclosure.

Turning to FIGS. 4 through 6, now that the construction of laundry appliance 100 and the configuration of controller 166 according to exemplary embodiments have been presented, exemplary methods 400, 500, and 600 of operating a heat pump appliance, such as a laundry appliance, will be described. Although the discussion below refers to the exemplary methods 400, 500, and 600 of operating laundry appliance 100, one skilled in the art will appreciate that the exemplary methods 400, 500, and 600 are applicable to the operation of a variety of other heat pump appliances. In exemplary embodiments, the various method steps as disclosed herein may be performed by controller 166 or a separate, dedicated controller.

FIGS. 4 through 6 depict steps performed in a particular order for purpose of illustration and discussion. Those of ordinary skill in the art, using the disclosures provided herein, will understand that (except as otherwise indicated) methods 400, 500, and 600 are not mutually exclusive. Moreover, the steps of the methods 400, 500, and 600 can be modified, adapted, rearranged, omitted, interchanged, or expanded in various ways without deviating from the scope of the present disclosure.

Advantageously, methods in accordance with the present disclosure may prevent the accumulation of moisture (e.g., on, at, or near an evaporator). Notably, corrosion caused by such moisture may be prevented. Additionally or alternatively, the formation of mildew, mold, or bacterial growth may be prevented.

Turning especially to FIG. 4, at 410, the method 400 includes activating a fluid compressor. Specifically, the fluid compressor is activated to rotate or otherwise motivate fluid refrigerant through the corresponding sealed system. Thus, the sealed system may perform a vapor-compression or heat exchange cycle, as described above.

At 420, the method 400 includes activating a blower fan. As described above, the blower fan is directed at the condenser. In turn, 420 includes rotating the blower fan or otherwise moving the blower fan to motivate an airflow across the condenser. Specifically, the blower fan motivates air along the air flow path (e.g., through the drum or otherwise within the cabinet. Such activation or rotation of the blower fan may heat or dry articles within the drum (e.g., as part of a dry cycle).

At 430, the method 400 includes directing the fluid compressor to an inactive state (e.g., following 410 and 420). In other words, the compressor may be deactivated or otherwise halted to stop the motivation of refrigerant through the sealed system. For instance, at the end of the dry cycle (e.g., generally corresponding to a load of articles), the fluid compressor may be turned off. Once directed to the inactive state, the fluid compressor may be held in the inactive state such that the vapor-compression cycle is not continued or restarted and the fluid compressor is not reactivated. It is noted that although the fluid compressor is directed to the inactive state, the blower fan may be held in the active state (e.g., as a continuation of 420), or otherwise keep motivating the airflow during or following 430.

At 440, the method 400 includes detecting an evaporator temperature. Specifically, evaporator temperature is detected or measured at the evaporator temperature sensor mounted on or adjacent to the evaporator, as described above. In some embodiments, evaporator temperature is detected following 420 and while the compressor is in the inactive state. Thus, 440 may follow or occur simultaneously to at least a portion of 430 (e.g., immediately after or in response to 430). In optional embodiments, 440 follows or is in response to another predetermined condition, such as expiration of a timer following (e.g., counting down from) 430.

Separate from or in addition to 440, the method 400 may include detecting a condenser temperature. Specifically, condenser temperature is detected or measured at the condenser temperature sensor mounted on or adjacent to the condenser, as described above. In some embodiments, condenser temperature is detected following 420 and while the compressor is in the inactive state (e.g., simultaneously to or otherwise generally in tandem with 440). Thus, detecting condenser temperature may follow or occur simultaneously to at least a portion of 430 (e.g., immediately after or in response to 430). In optional embodiments, detecting condenser temperature follows or is in response to another predetermined condition, such as expiration of a timer following (e.g., counting down from) 430.

Further separate from or in addition to 440, the method 400 may include detecting a humidity level within the cabinet. Specifically, humidity level is detected or measured at the humidity sensor mounted within the cabinet apart from the evaporator and condenser, as described above. In some embodiments, humidity level is detected following 420 and while the compressor is in the inactive state (e.g., simultaneously to or otherwise generally in tandem with 440). Thus, detecting humidity level may follow or occur simultaneously to at least a portion of 430 (e.g., immediately after or in response to 430). In optional embodiments, detecting humidity level follows or is in response to another predetermined condition, such as expiration of a timer following (e.g., counting down from) 430. Once the humidity level is detected, a dew point (e.g., in degrees Celsius or Fahrenheit) within the cabinet may be determined based on the humidity level, as would be understood.

At 450, the method 400 includes adjusting activation of the blower fan based on the detected evaporator temperature at 440. For instance, the blower fan may be deactivated or directed to continue rotating based, at least in part, on the result of 440. In other words, the blower fan may be directed to an inactive state or directed to maintain the active state (e.g., at the same rotation or air speed or, alternatively, at a different rotation or air speed from 420). In addition to the detected evaporator temperature itself, one or more comparisons or operations including the evaporator temperature may be used to determine or direct the adjustment of the activation of the blower fan.

In some embodiments, 450 is further based on the detected condenser temperature. For instance, 400 may further comparing the detected condenser temperature to the detected evaporator temperature. In certain embodiments, 400 includes determining a difference between the detected condenser temperature and the detected evaporator temperature that is less than or equal to a set threshold (e.g., programmed threshold value within the controller). In response to such a determination, 450 includes directing the blower fan to an inactive state and, thus, halts the airflow through the air flow path. In additional or alternative embodiments, 400 includes determining a difference between the detected condenser temperature and the detected evaporator temperature that is greater than the set threshold. In response to such a determination, 450 includes directing the blower fan maintain an active state continuing the airflow and, thus, continues the airflow through the air flow path.

In alternative embodiments, 450 is further based on the determined dew point. For instance, 400 may further comparing the detected evaporator temperature to the determined dew point. In certain embodiments, 400 includes determining the detected evaporator temperature is greater than determined dew point. In response to such a determination, 450 includes directing the blower fan to an inactive state and, thus, halts the airflow through the air flow path. In additional or alternative embodiments, 400 includes determining the detected evaporator temperature is less than or equal to the determined dew point. In response to such a determination, 450 includes directing the blower fan maintain an active state continuing the airflow and, thus, continues the airflow through the air flow path.

In optional embodiments, multiple sensor readings may be used to make multiple determinations of the dew point and corresponding adjustments to the blower fan activation as part of 400. For instance, a first evaporator temperature may be detected and a first humidity level and dew point may be determined, as described above. Moreover, a determination may be made that the detected first evaporator temperature is greater than first determined dew point. In response to such a determination, 450 includes directing the blower fan to an inactive state halting the airflow through the air flow path. Subsequently, 400 may include detecting a second humidity level within the cabinet and determining a second dew point based on the detected second humidity level. Moreover, also following 450, a second evaporator temperature may be detected. A determination may be made that the second evaporator temperature is less than or equal to the determined second dew point. In response to such a determination, 400 may include directing the blower fan back to an active state and motivating the airflow in response. Thus, the blower fan may be reactivated to again motivate the airflow (e.g., while the drum remains empty or before a new/intervening dry cycle has begun). During this response, the fluid compressor may remain in the inactive state (e.g., since it has not been reactivated following 430).

Separate from or in addition to adjusting activation of the blower fan, 400 may include actuating or opening the movable damper. For instance, the movable damper may be opened (e.g., moved to and held in the open position) while the fluid compressor is in the inactive state following 420.

Turning now to FIG. 5, at 510, the method 500 includes activating a fluid compressor. Specifically, the fluid compressor is activated to rotate or otherwise motivate fluid refrigerant through the corresponding sealed system. Thus, the sealed system may perform a vapor-compression or heat exchange cycle, as described above.

At 520, the method 500 includes activating a blower fan. As described above, the blower fan is directed at the condenser. In turn, 520 includes rotating the blower fan or otherwise moving the blower fan to motivate an airflow across the condenser. Specifically, the blower fan motivates air along the air flow path (e.g., through the drum or otherwise within the cabinet. Such activation or rotation of the blower fan may heat or dry articles within the drum (e.g., as part of a dry cycle).

At 530, the method 500 includes directing the fluid compressor to an inactive state (e.g., following 510 and 520). In other words, the compressor may be deactivated or otherwise halted to stop the motivation of refrigerant through the sealed system. For instance, at the end of the dry cycle (e.g., generally corresponding to a load of articles), the fluid compressor may be turned off. Once directed to the inactive state, the fluid compressor may be held in the inactive state such that the vapor-compression cycle is not continued or restarted and the fluid compressor is not reactivated. It is noted that although the fluid compressor is directed to the inactive state, the blower fan may be held in the active state (e.g., as a continuation of 520), or otherwise keep motivating the airflow during or following 530.

At 542, the method 500 includes detecting an evaporator temperature.

Specifically, evaporator temperature is detected or measured at the evaporator temperature sensor mounted on or adjacent to the evaporator, as described above. In some embodiments, evaporator temperature is detected following 520 and while the compressor is in the inactive state. Thus, 542 may follow or occur simultaneously to at least a portion of 530 (e.g., immediately after or in response to 530). In optional embodiments, 542 follows or is in response to another predetermined condition, such as expiration of a timer following (e.g., counting down from) 530.

At 544, the method 500 includes detecting a condenser temperature.

Specifically, condenser temperature is detected or measured at the condenser temperature sensor mounted on or adjacent to the condenser, as described above. Generally, condenser temperature is detected following 520 and while the compressor is in the inactive state (e.g., simultaneously to or otherwise generally in tandem with 542). Thus, detecting condenser temperature may follow or occur simultaneously to at least a portion of 530 (e.g., immediately after or in response to 530). In optional embodiments, detecting condenser temperature follows or is in response to another predetermined condition, such as expiration of a timer following (e.g., counting down from) 530.

At 550, the method 500 includes evaluating a temperature difference between the evaporator and condenser temperatures. Specifically, 550 includes determining the difference between the detected evaporator and condenser temperatures. Once the difference is calculated, the difference can be compared to a set threshold (e.g., predetermined and programmed within the controller). If the difference between the temperatures is greater than the set threshold, the method 500 may proceed to 555A. By contrast, if the difference between the temperatures is less than or equal to the set threshold, the method 500 may proceed to 555B.

At 555A, the method 500 includes directing the blower fan to maintain the active state. In other words, the blower fan may be directed to keep rotating or otherwise motivating air along the air path. Air may thus recirculate while the sealed system (e.g., refrigerant flow) otherwise remains inactive. Subsequently, the method 500 may return to 542 (e.g., for additional or subsequent temperature detections).

At 555B, the method 500 includes directing the blower fan to an inactive state. In other words, the blower fan may be stopped or halted to end active motivation of air along the air path.

Turning now to FIG. 6, at 610, the method 600 includes activating a fluid compressor. Specifically, the fluid compressor is activated to rotate or otherwise motivate fluid refrigerant through the corresponding sealed system. Thus, the sealed system may perform a vapor-compression or heat exchange cycle, as described above.

At 620, the method 600 includes activating a blower fan. As described above, the blower fan is directed at the condenser. In turn, 620 includes rotating the blower fan or otherwise moving the blower fan to motivate an airflow across the condenser. Specifically, the blower fan motivates air along the air flow path (e.g., through the drum or otherwise within the cabinet. Such activation or rotation of the blower fan may heat or dry articles within the drum (e.g., as part of a dry cycle).

At 630, the method 600 includes directing the fluid compressor to an inactive state (e.g., following 610 and 620). In other words, the compressor may be deactivated or otherwise halted to stop the motivation of refrigerant through the sealed system. For instance, at the end of the dry cycle (e.g., generally corresponding to a load of articles), the fluid compressor may be turned off. Once directed to the inactive state, the fluid compressor may be held in the inactive state such that the vapor-compression cycle is not continued or restarted and the fluid compressor is not reactivated. It is noted that although the fluid compressor is directed to the inactive state, the blower fan may be held in the active state (e.g., as a continuation of 620), or otherwise keep motivating the airflow during or following 630.

At 642, the method 600 includes detecting a (e.g., first) humidity level within the cabinet. Specifically, humidity level is detected or measured at the humidity sensor mounted within the cabinet apart from the evaporator and condenser, as described above. In some embodiments, humidity level is detected following 620 and while the compressor is in the inactive state. Thus, detecting humidity level may follow or occur simultaneously to at least a portion of 630 (e.g., immediately after or in response to 630). In optional embodiments, detecting humidity level follows or is in response to another predetermined condition, such as expiration of a timer following (e.g., counting down from) 630. Once the humidity level is detected, a (e.g., first) dew point (e.g., in degrees Celsius or Fahrenheit) within the cabinet may be determined based on the humidity level, as would be understood.

At 644, the method 600 includes detecting a (e.g., first) evaporator temperature. Specifically, evaporator temperature is detected or measured at the evaporator temperature sensor mounted on or adjacent to the evaporator, as described above. Generally, evaporator temperature is detected following 620 and while the compressor is in the inactive state (e.g., simultaneously to or otherwise generally in tandem with 642). Thus, detecting evaporator temperature may follow or occur simultaneously to at least a portion of 630 (e.g., immediately after or in response to 630). In optional embodiments, detecting evaporator temperature follows or is in response to another predetermined condition, such as expiration of a timer following (e.g., counting down from) 630.

At 650, the method 600 includes evaluating a difference between the (e.g., first) evaporator temperature and the (e.g., first) determined dew point. Specifically, 650 includes comparing the detected evaporator temperature and the determined dew point. If the evaporator temperature is not greater than or equal to the set threshold, the method 600 may proceed to 655A. By contrast, if the evaporator temperature is greater than the determined dew point, the method 600 may proceed to 655B.

At 655A, the method 600 includes directing the blower fan to maintain the active state. In other words, the blower fan may be directed to keep rotating or otherwise motivating air along the air path. Air may thus recirculate while the sealed system (e.g., refrigerant flow) otherwise remains inactive. Subsequently, the method 600 may return to 642 (e.g., for additional or subsequent temperature detections).

At 655B, the method 600 includes directing the blower fan to an inactive state. In other words, the blower fan may be stopped or halted to end active motivation of air along the air path. Following 655B, the method 600 may proceed to 660.

At 660, the method 600 includes determining a maintenance condition has been achieved following 655B. For instance, 660 may include determining articles have been removed from the drum. Such a determination may be made directly or inferred, such as by detected opening and closing of the laundry appliance door, a would be understood in light of the present disclosure. In additional or alternative embodiments, 660 may include determining occurrence another predetermined condition, such as expiration of a timer following (e.g., counting down from) 655B.

At 672, the method 600 includes detecting a (e.g., second) humidity level within the cabinet (e.g., in response to 660). Specifically, humidity level is detected or measured at the humidity sensor mounted within the cabinet apart from the evaporator and condenser, as described above. Once the humidity level is detected, a (e.g., second) dew point (e.g., in degrees Celsius or Fahrenheit) within the cabinet may be determined based on the humidity level, as would be understood.

At 674, the method 600 includes detecting a (e.g., second) evaporator temperature. Specifically, evaporator temperature is detected or measured at the evaporator temperature sensor mounted on or adjacent to the evaporator, as described above. Generally, evaporator temperature is detected following 660 and while the compressor is in the inactive state (e.g., simultaneously to or otherwise generally in tandem with 672). Thus, detecting evaporator temperature may follow or occur simultaneously to at least a portion of 660 (e.g., immediately after or in response to 660).

At 680, the method 600 includes evaluating a difference between the (e.g., second) evaporator temperature and the (e.g., second) determined dew point. Specifically, 680 includes comparing the detected evaporator temperature and the determined dew point. If the evaporator temperature is not less than or equal to the set threshold, the method 600 may proceed to 685A. By contrast, if the evaporator temperature is less than or equal to the determined dew point, the method 600 may proceed to 685B.

At 685A, the method 600 includes directing the blower fan to an inactive state. In other words, the blower fan may be stopped or halted to end active motivation of air along the air path. Subsequently, the method 600 may return to 672 (e.g., for additional or subsequent temperature detections).

At 685B, the method 600 includes directing the blower fan back to the active state. In other words, the blower fan may be directed to reactivated to again rotate or otherwise motivate air along the air path. Air may thus recirculate while the sealed system (e.g., refrigerant flow) otherwise remains inactive. In some embodiments, the reactivation is for a set period of time (e.g., reactivation time period). Subsequently, the method 600 may return to 672 (e.g., for additional or subsequent temperature detections).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A heat pump appliance comprising:

a cabinet defining an air path therethrough;

a sealed thermodynamic assembly mounted within the cabinet, the sealed thermodynamic assembly comprising a fluid compressor, an evaporator, and a condenser disposed along the air path;

a blower fan mounted within the cabinet to motivate an airflow across the condenser;

a temperature sensor mounted to the evaporator to detect temperature at the evaporator; and a controller in operative communication with the fluid compressor, the blower fan, and the temperature sensor, the controller being configured to direct a drying operation comprising:

activating the fluid compressor to motivate a refrigerant through the sealed thermodynamic assembly, activating the blower fan to motivate the airflow across the condenser, directing the fluid compressor to an inactive state following activating the blower fan, detecting an evaporator temperature at the temperature sensor while the fluid compressor is in the inactive state following activating the blower fan, and adjusting activation of the blower fan based on the evaporator temperature.

2. The heat pump appliance of claim 1, wherein the temperature sensor is an evaporator temperature sensor, wherein the heat pump appliance further comprises a condenser temperature sensor mounted to the condenser to detect temperature at the condenser, wherein the drying operation further comprises detecting a condenser temperature at the condenser temperature sensor while the fluid compressor is in the inactive state following activating the blower fan, and wherein adjusting activation of the blower fan is further based on the condenser temperature.

3. The heat pump appliance of claim 2, wherein the drying operation further comprises determining a difference between the condenser temperature and the evaporator temperature that is less than or equal to a set threshold, and wherein adjusting activation of the blower fan comprises directing the blower fan to an inactive state halting the airflow in response to determining the difference less than or equal to the set threshold.

4. The heat pump appliance of claim 2, wherein the drying operation further comprises determining a difference between the condenser temperature and the evaporator temperature that is greater than a set threshold, and wherein adjusting activation of the blower fan comprises directing the blower fan maintain an active state continuing the airflow in response to determining the difference greater the set threshold.

5. The heat pump appliance of claim 1, wherein the heat pump appliance further comprises a humidity sensor mounted within the cabinet apart from the temperature sensor to detect humidity within the cabinet, wherein the drying operation further comprises detecting a humidity level within the cabinet and determining a dew point based on the humidity level, and wherein adjusting activation of the blower fan is further based on the determined dew point.

6. The heat pump appliance of claim 5, wherein the drying operation further comprises determining the evaporator temperature is greater than to the determined dew point, and wherein adjusting activation of the blower fan comprises directing the blower fan to an inactive state halting the airflow in response to determining the evaporator temperature is greater than the determined dew point.

7. The heat pump appliance of claim 6, wherein the humidity level is a first humidity level, wherein the determined dew point is a first dew point, wherein the determined evaporator temperature is a first evaporator temperature, wherein the drying operation further comprises detecting a second humidity level within the cabinet and determining a second dew point based on the second humidity level following directing the blower fan to the inactive state, detecting a second evaporator temperature at the temperature sensor following directing the blower fan to the inactive state, determining the second evaporator temperature is less than or equal to the determined second dew point, and directing the blower fan back to an active state motivating the airflow in response to determining the second evaporator temperature is less than or equal to the determined second dew point.

8. The heat pump appliance of claim 5, wherein the drying operation further comprises determining the evaporator temperature is less than or equal to the determined dew point, and wherein adjusting activation of the blower fan comprises directing the blower fan maintain an active state continuing the airflow in response to determining the evaporator temperature is less than or equal to the determined dew point.

9. The heat pump appliance of claim 1, further comprising:

a duct defining the air path within the cabinet; and a movable damper mounted on the duct to selectively open the air path to a surrounding portion of the cabinet, wherein the drying operation further comprises opening the movable damper while the fluid compressor is in the inactive state following activating the blower fan.

10. The heat pump appliance of claim 9, wherein opening the movable damper is in response to directing the fluid compressor to an inactive state.

11. A method of operating a heat pump appliance comprising a cabinet defining an air path therethrough, a sealed thermodynamic assembly mounted within the cabinet, a fluid compressor, an evaporator, a condenser disposed along the air path, a blower fan mounted within the cabinet to motivate an airflow across the condenser, and a temperature sensor mounted to the evaporator, the method comprising:

activating the fluid compressor to motivate a refrigerant through the sealed thermodynamic assembly;

activating the blower fan to motivate the airflow across the condenser;

directing the fluid compressor to an inactive state following activating the blower fan;

detecting an evaporator temperature at the temperature sensor while the fluid compressor is in the inactive state following activating the blower fan; and adjusting activation of the blower fan based on the evaporator temperature.

12. The method of claim 11, wherein the temperature sensor is an evaporator temperature sensor, wherein the heat pump appliance further comprises a condenser temperature sensor mounted to the condenser to detect temperature at the condenser, wherein the method further comprises detecting a condenser temperature at the condenser temperature sensor while the fluid compressor is in the inactive state following activating the blower fan, and wherein adjusting activation of the blower fan is further based on the condenser temperature.

13. The method of claim 12, further comprising determining a difference between the condenser temperature and the evaporator temperature that is less than or equal to a set threshold, wherein adjusting activation of the blower fan comprises directing the blower fan to an inactive state halting the airflow in response to determining the difference less than or equal to the set threshold.

14. The method of claim 12, further comprising determining a difference between the condenser temperature and the evaporator temperature that is greater than a set threshold, wherein adjusting activation of the blower fan comprises directing the blower fan maintain an active state continuing the airflow in response to determining the difference greater the set threshold.

15. The method of claim 11, wherein the heat pump appliance further comprises a humidity sensor mounted within the cabinet apart from the temperature sensor to detect humidity within the cabinet, wherein the method further comprises detecting a humidity level within the cabinet and determining a dew point based on the humidity level, and wherein adjusting activation of the blower fan is further based on the determined dew point.

16. The method of claim 15, further comprising determining the evaporator temperature is greater than to the determined dew point, wherein adjusting activation of the blower fan comprises directing the blower fan to an inactive state halting the airflow in response to determining the evaporator temperature is greater than the determined dew point.

17. The method of claim 16, wherein the humidity level is a first humidity level, wherein the determined dew point is a first dew point, wherein the determined evaporator temperature is a first evaporator temperature, wherein the method further comprises:

detecting a second humidity level within the cabinet and determining a second dew point based on the second humidity level following directing the blower fan to the inactive state;

detecting a second evaporator temperature at the temperature sensor following directing the blower fan to the inactive state;

determining the second evaporator temperature is less than or equal to the determined second dew point; and directing the blower fan back to an active state motivating the airflow in response to determining the second evaporator temperature is less than or equal to the determined second dew point.

18. The method of claim 15, further comprising determining the evaporator temperature is less than or equal to the determined dew point, wherein adjusting activation of the blower fan comprises directing the blower fan maintain an active state continuing the airflow in response to determining the evaporator temperature is less than or equal to the determined dew point.

19. The method of claim 11, wherein the heat pump appliance further comprises a duct defining the air path within the cabinet, and a movable damper mounted on the duct to selectively open the air path to a surrounding portion of the cabinet, wherein the method further comprises opening the movable damper while the fluid compressor is in the inactive state following activating the blower fan.

20. The method of claim 19, wherein opening the movable damper is in response to directing the fluid compressor to an inactive state.

* * * * *